US005775977A

United States Patent [19]

Platzer et al.

[11] Patent Number: 5,775,977

[45] Date of Patent: Jul. 7, 1998

[54] PROCESS FOR THE MECHANICAL ROUGHENING OF THE SURFACE OF A PRINTING PLATE SUBSTRATE

[75] Inventors: Stephan J. W. Platzer, Califon, N.J.; Walter Mackert, Mainz; Rudolf Neubauer, Oestrich-Winkel, both of Germany

[73] Assignee: AGFA-Gevaert AG, Leverkusen, Germany

[21] Appl. No.: 652,167

[22] Filed: May 23, 1996

Related U.S. Application Data

[62] Division of Ser. No. 530,573, Sep. 19, 1995, abandoned.

[30] Foreign Application Priority Data

Sep. 30, 1994 [DE] Germany ..... 44 35 221.2

[51] Int. Cl.[6] ..... B24B 1/00

[52] U.S. Cl. ..... 451/37; 15/DIG. 6; 451/59

[58] Field of Search ..... 15/21.1, 23, 50.3, 15/82, 111, 166, 183, 199, 207.2, DIG. 6; 134/7, 32; 205/206, 661, 662, 663; 216/52; 451/36, 37, 59, 527

[56] References Cited

U.S. PATENT DOCUMENTS

| | | | |
|---|---|---|---|
| 2,666,282 | 1/1954 | Peterson | 451/59 X |
| 3,186,019 | 6/1965 | Hattori . | |
| 3,343,195 | 9/1967 | Menges . | |
| 3,929,591 | 12/1975 | Chu et al. | 204/17 |
| 4,361,922 | 12/1982 | Karal | 15/1.5 R |
| 4,477,317 | 10/1984 | Chu et al. | 204/33 |
| 4,714,528 | 12/1987 | Takeuchi et al. | 451/54 X |
| 4,756,044 | 7/1988 | Clark | 15/182 |
| 4,909,894 | 3/1990 | Uesugi et al. | 451/57 X |
| 5,050,262 | 9/1991 | Malish | 15/180 |
| 5,575,704 | 11/1996 | Hotani | 451/59 X |

FOREIGN PATENT DOCUMENTS

| | | |
|---|---|---|
| 0 595 179 | 5/1994 | European Pat. Off. . |

*Primary Examiner*—Timothy V. Eley
*Attorney, Agent, or Firm*—Foley & Lardner

[57] ABSTRACT

The mechanical roughening of the surface of a printing plate substrate comprising aluminum or an aluminum alloy is carried out by wet brushing with the use of a cylinder brush 1 in which brush rows 2, 3 having bundles of organic fibers 22 and metal wires 33 are arranged side by side on the surface 7. The suspension used for the wet brushing contains from 5 to 80% by weight of abrasive particles in water.

11 Claims, 2 Drawing Sheets

PROCESS FOR THE MECHANICAL ROUGHENING OF THE SURFACE OF A PRINTING PLATE SUBSTRATE

This application is a division, of application Ser. No. 08/530,573, filed Sep. 19, 1995 now abandoned.

BACKGROUND OF THE INVENTION

1. Field of the Invention

The present invention relates to a process for the mechanical roughening of the surface of a printing plate substrate comprising aluminum or an aluminum alloy by wet brushing. The present invention also relates to a cylinder brush for carrying out the process.

2. Description of Related Art

The production of substrates for photosensitive printing plates requires roughening of the substrate surface, which is generally done by carrying out the roughening first mechanically and then electrochemically in an electrolyte. The mechanical roughening can be effected by brushing with a wire brush, sandblasting, wet and dry brushing techniques, ball milling and other similar techniques.

The printing process is carried out using a printing plate having an essentially even surface. The printing plate is prepared by roughening and chemical treatment. The chemical treatment is either a purely chemical treatment in a solution or an electrochemical treatment. This preparation provides a printing surface which accepts only the oily printing ink and repels water in the printing areas, and conversely accepts water and repels the printing ink in the nonprinting areas.

To carry out the printing process, the processed printing plate is moistened and the printing ink applied. In offset printing, the printing plate is then pressed against a rubber blanket which transfers the printed image inked by the printing ink to the paper to be printed. In the case of direct printing, the printing plate is pressed directly against the paper. High-quality images without any noticeable preferred direction are desirable. An undesired direction may occur when the surface of the printing plate has a nonuniform structure. Furthermore, it is desirable to produce consistent high-quality images when the same printing plate and the same printing plate type are used. A nonreproducible image may occur when the surface of the printing plate is not of constant quality or does not retain its surface quality in a long print run.

A photosensitive printing plate is produced by applying a photosensitive layer to a roughened substrate, which generally comprises aluminum or an aluminum alloy. As aforementioned, the surface is roughened either mechanically, purely chemically or electrochemically or by a combination of two or three of these techniques. The roughening is usually followed by an etch process, anodization and treatment of the surface which renders the surface hydrophilic if required. Finally, a photosensitive layer is applied to the roughened surface in order to obtain a presensitized printing plate. The printing plate is exposed imagewise to actinic radiation, developed and conserved in order to obtain a processed printing plate, which is then mounted in a printing press for printing.

A number of processes, as already mentioned above, are generally known in the area of the roughening of the surface of substrates for printing plates. These processes, however, have disadvantages. For example, in the case of ball milling, the edges of the substrate have a roughness which differs from that of the center of the substrate, so that the plate edges must be cut off in order to ensure uniform roughness over the width of the substrate. Brushing with a wire brush typically gives rise to the problem that the roughness is oriented, the orientation being in the direction of rotation of the wire brush. Characteristic center line average values $R_a$ of wire-brushed material are 0.25 μm in the running direction of a substrate strip and 0.45 μm transverse to the strip running direction. Thus, there is an overall 50% difference between the two directions perpendicular to one another.

In the case of sandblasting substrates, the spray jets are subject to considerable wear due to the abrasive sand particles, and, as a result, must frequently be replaced. In electrochemical roughening, the electricity consumption is high and there are typically problems with the disposal of the acid-containing solutions which contain dissolved aluminum ions. If purely chemical roughening is employed, the residence time of the substrate in the chemical bath is relatively long in comparison with electrochemical roughening.

In the case of wet brushing with a suspension in which small abrasive particles are dispersed in an aqueous solution, the suspension is rubbed against the surface of the substrate by means of a brush or a set of brushes. The bristles of the brushes are usually plastic, such as nylon or polypropylene, and the wet brushing is carried out until the desired surface roughness is reached. The disadvantage with this technique is that the plastic bristles are subject to considerable abrasion and the edges of the substrate cut off the bristles so that the bristles in the edge regions are considerably shorter than those in the other regions of the brush. As a result, if a broader substrate strip is then brushed, the shorter bristles cannot sufficiently roughen the broader substrate strip in these edge regions. This leads to considerably less roughening in the edge regions when compared with the other regions.

Using wire brushes instead of plastic brushes for the wet brushing results in the above-mentioned disadvantages, specifically, the surface of the substrate is not uniform in terms of roughness but has a preferred orientation. The roughness of the substrate surface also varies with the wear of the bristles.

The wet brushing of aluminum substrates is described, for example, in U.S. Pat. No. 3,929,591 and U.S. Pat. No. 4,477,317.

U.S. Pat. No. 4,714,528 discloses a cylinder brush which is used for wet brushing. A substrate comprising aluminum or an aluminum alloy which contains 99% by weight of aluminum and small amounts of silicon, iron, copper, zinc, manganese, magnesium, chromium, lead, bismuth, calcium, indium, gallium, nickel and the like, is processed with a suspension under high liquid pressure which is applied at an angle to the surface of the substrate. The suspension contains finely milled powder of abrasive substances and, if required, may furthermore contain an acid or an alkali. This roughening step by means of a suspension is followed by a brush treatment, the cylinder brush comprising nylon fibers, polypropylene fibers, animal hair, steel wire or the like. The fibers or bristles have a uniform length and are mounted uniformly over the base part, of the cylinder brush. The length of the bristles or fibers is from 10 to 150 mm and the diameter of the individual fibers or wires ranges from 0.1 mm to 1.5 mm. The cylinder brush is operated at a speed in the range from 200 to 2000 revolutions per minute. The abrasive suspension is sprayed through a spray nozzle onto the substrate under high liquid pressure before the substrate passes the cylinder brushes. The brushes are pressed against the substrate so that the substrate surface is roughened at a constant pressure between the support rolls and the cylinder brushes. After the roughening, the roughened surface of an aluminum substrate has a center line average value $R_a$ of from 0.3 to about 1.2 μm, in particular from 0.35 to 0.8 μm.

SUMMARY OF THE INVENTION

One object of the present invention is to improve and develop a wet brushing process for roughening substrates for printing plates in such a way that very uniform center line average values are obtained without pronounced directional orientation. Another object is to provide little wear of the cylinder brush material compared with known cylinder brushes. Still another object of the present invention is to provide a cylinder brush which can be used in the process and which has a constant center line average value in conjunction with a longer service life than conventional cylinder brushes.

In accomplishing the foregoing objects, there has been provided according to the present invention a wet brushing process carried out with a suspension of from 5 to 80% by weight of abrasive particles in water with the simultaneous use of organic fibers and metal wires arranged side by side.

In a preferred embodiment of the process, the ratio of the organic fibers to the metal wires is in the range from 0.01 to 10. More preferably, the ratio of the organic fibers to the metal wires is in the range from 0.05 to 5, in particular from 0.1 to 1.0.

In another preferred embodiment of the process, the particle size in the suspension is from 1 to 500 μm, more preferably from 20 to 50 μm. The wet brushing can be carried out in such a way that the mechanically measured center line average values $R_a$ in the running direction of the printing plate substrate and transverse to the running direction differ from one another by not more than 14%, based on $R_a$ in the running direction. The center line average values $R_a$ in the running direction are in the range from 0.32 to 0.47 μm and the center line average values $R_a$ transverse to the running direction are in the range from 0.35 to 0.50 μm. In general, the center line average values $R_a$ may be in the range from 0.2 to 0.6 μm in each of the two directions.

In another aspect of the present invention, a cylinder brush for carrying out the process is provided. The brush includes a surface occupied by one or more brush strips, which contain both fibers and wires wherein the fiber material has a different composition than the wire material.

In a preferred embodiment of the cylinder brush, two groups of the one or more brush strips are arranged over the cylinder surface, each group of brush strips comprising a certain material in the form of fibers or wires, and the brush strips forming a repeating pattern comprising one or more brush strips of one group and one or more brush strips of the other group. In another preferred embodiment, it is also possible for the individual one or more brush strips to contain a mixture of fibers and wires, wherein the fiber material is different from the wire material.

In still another preferred development of the invention, the material of the brush strips of one group is a polymer while the material of the brush strips of the other group is a metal.

BRIEF DESCRIPTION OF THE DRAWINGS

The present invention is illustrated in more detail below with reference to the drawings.

DETAILED DESCRIPTION

Figure 1:
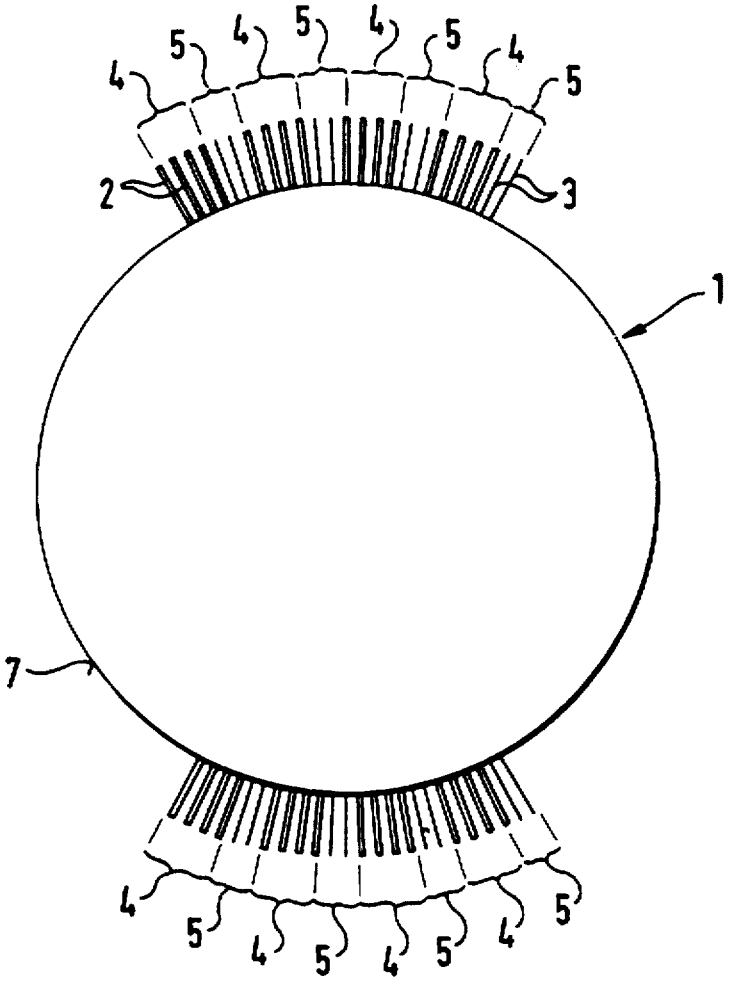
FIG. 1 shows a cross-section through a first embodiment of a cylinder brush according to the present invention.

Referring to FIG. 1, brush strips 2 and 3 are generally distributed over a cylinder surface 7 of a cylinder brush 1, the front of a first fiber and of a first wire of each of the brush strips being evident in cross-section. The individual brush strips 2 or 3 include a large number of fibers or wires arranged in rows one behind the other in the direction of view onto FIG. 1 and extends over the entire width of the cylinder brush 1, which runs perpendicular to the plane of the drawing in FIG. 1. The fibers of a group 4 of the brush strip 2 are preferably polymer fibers as shown in FIG. 1 and generally have a greater thickness than the wires of a further group 5. The polymer of the brush strips 2 are preferably selected from polyamides, polyacrylonitriles, polyesters, polyethylenes, polyimides, polyolefins, polypropylenes, polyurethanes, polyvinyl chlorides, cellulose derivatives and combinations of the above polymers. A preferred fiber material for the brush strips 2 are polyamides, such as nylon 6, nylon 6.6, nylon 6.10, nylon 6.12 and combinations of these polyamides. In order to increase the abrasion resistance of the polyamides, they are preferably filled with inert particles, for example silicon carbide.

The metal of the wires of the brush strips 3 are preferably selected from stainless steel, steel, aluminum, brass, bronze, copper, iron and alloys of these metals. The wires can also be formed of two or more individual metals. Due to its high abrasion resistance and its advantageous price, stainless steel is preferably used for the brush strips 3.

Figure 2:
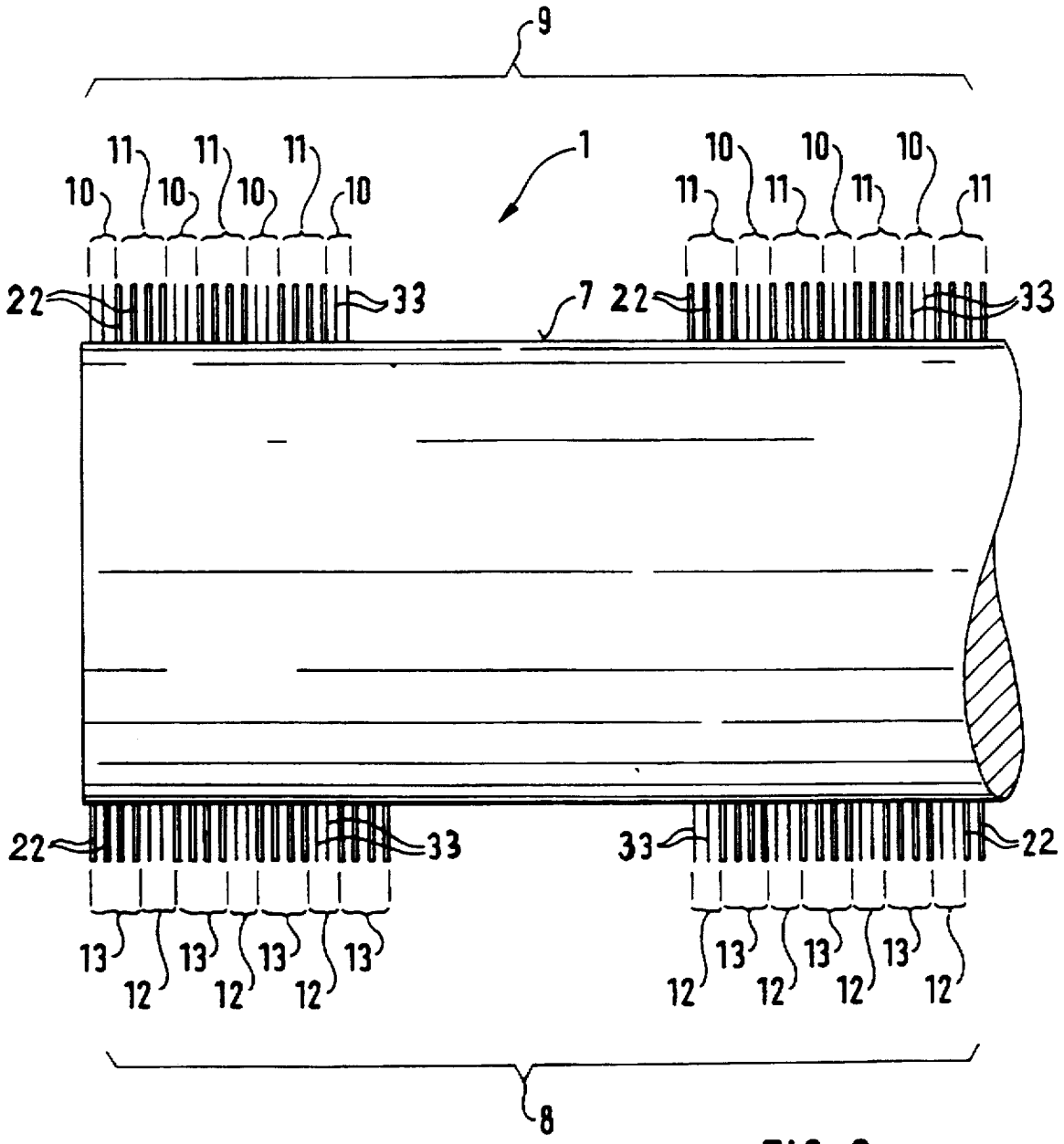
FIG. 2 shows a longitudinal section through a second embodiment of the cylinder brush according to the present invention.

In the case of a first embodiment shown in FIG. 1, each of the individual brush strips 2 and 3 is generally formed either substantially or preferably completely only from polymer fibers or substantially or preferably completely only from metal wires, whereas this is not the case in the second embodiment of the cylinder brush 7, shown in FIG. 2. The metals and polymers described above with respect to the first embodiment also apply to the wires and polymers of the embodiment illustrated in FIG. 2.

As is evident from FIG. 2, a lower brush strip 8 preferably comprises groups 12 of metal wires 33 and groups 13 of the polymer fibers 22. Individual group 12 may comprise, for example, two metal wires 33 and the individual group 13 may comprise four polymer fibers 22. The upper brush strip 9 comprises groups 10 of metal wires 33 and groups 11 of polymer fibers 22. Individual group 10 may include two metal wires and the individual group 11 may include four polymer fibers. Of course, the number of metal wires or of fibers in the individual groups may be greater or smaller than the numbers in the embodiment as shown in FIG. 2. The groups 10 and 11 of one category of brush strips 9, of which only an individual brush strip is shown in FIG. 2, and the groups 12 and 13 of the other category of brush strips 8, of which likewise only an individual brush strip is shown in FIG. 2, may coincide or be staggered in their patterns, as is evident from FIG. 2.

Substrate sheets or strips which are often essentially roughened in the process according to the present invention generally comprise pure aluminum or an aluminum alloy. The alloy is generally composed of an aluminum as the main component and small amounts of silicon, iron, copper, zinc, manganese, magnesium, chromium, lead, bismuth, calcium, indium, gallium, nickel and the like. In every case, the amount of aluminum is preferably ≧98% by weight. The thickness of the aluminum substrate is generally chosen in the range from 0.01 to 0.5 mm, depending on the parameters breaking strength, flexural strength, mechanical resistance, elongation and the like, which parameters have to be taken into account for certain applications of a lithographic printing plate in a printing press. Steel sheets or strips may also be used but, owing to their relatively high weight and their rigidity, they are not as preferred as aluminum or aluminum alloy.

Before wet brushing with a suspension, one or both sides of the aluminum substrate are preferably cleaned, degreased and/or etched by known methods. These methods include a treatment with a solution which generally contains sodium hydroxide with or without degreasing agents and etchants. The mixtures may also contain chemicals such as acetone, methanol, trichloroethylene and the like. The solution may additionally contain an aluminum ion source, for example sodium aluminate, up to a concentration which corresponds to the saturation point, in order to support the constancy of the process. The required concentrations and other treatment conditions generally depend on the specific surface roughness to be established. This process step can in general last from 5 seconds to 5 minutes. Thereafter, the surface is subjected to wet brushing with a suspension.

The suspension comprises water and a finely divided powder of an abrasive material. The fine abrasive powder material is used in the suspension generally in a concentration of from 5 to 80% by weight, preferably in the range from 15 to 40% by weight. The suspension may furthermore contain an acid or an alkali if required. Further additives, such as thickeners, surface treatment agents and flocculants and the like may also be present. Suitable abrasive materials comprise diamond dust, quartz, flintstone, granite, alumina, silica, kieselguhr, sand, emery, abrasives composed of iron silicates and aluminum silicates, talc, pumice, corundum, dolomite, magnesium oxide, clay, zirconia, iron, tungsten carbide and the like or a combination of two or more of the materials listed above. The abrasives generally have an average particle size in the range from 5 to 500 μm, preferably from 10 to 100 μm, particularly preferably from 20 to 50 μm.

The feed apparatus for the abrasive suspension preferably comprises a container having a capacity in the range from 100 to 10,000 liters, more preferably from 1,000 to 5,000 liters. A stirring means for the suspension may also be present in the container in order to prevent precipitation of solid particles. The stirring apparatus may be, for example, a propeller stirrer which extends into the container or a system for circulating the suspension. As a result of the constant motion of the suspension, precipitation of the solids in the suspension is prevented. A pump transports the suspension to a distributor nozzle. The pump delivery may be adjusted for an aluminum substrate strip so that the width of distribution, the strip speed, the brush speed and the solids contents of the suspension are taken into account. For example, a pump delivery of 400 liters per minute can be used for a width of distribution of 1 m, a strip speed of 50 meters per minute, a brush speed of 500 revolutions per minute and a solids content of 20% by weight.

The distributor nozzle distributes the suspension uniformly over the aluminum substrate, in particular in the form of a uniform curtain. The nozzle may have either a narrow slot or a number of holes close together. Before being fed to the distributor nozzle, the suspension is filtered in order to retain relatively large agglomerates which might block the slot or the holes.

One or more cylinder brushes 2, as have been described with reference to FIGS. 1 and 2, can be used for the wet brushing. The cylinder brush or cylinder brushes preferably rotates or rotate in the opposite direction to the running direction of the substrate strip. If the cylinder brush rotates in the same direction as the substrate strip, the tangential speed of the cylinder brush must differ from the strip running speed. The distributor nozzle preferably applies the suspension to the aluminum substrate directly in front of each cylinder brush. The cylinder brushes may be present on one or both sides of the substrate strip. The substrate strip is preferably transported horizontally if the cylinder brushes are present on one side, namely above the substrate strip, and is conveyed vertically if the cylinder brushes are arranged on both sides of the substrate strip. The number of revolutions of the cylinder brushes is in the range from 100 to 5,000 revolutions per minute, preferably from 200 to 500 revolutions per minute. The diameter of the individual cylinder brush is from 0.1 to 1 m. The contact path of the cylinder brush circumference with the aluminum substrate strip is, at a predetermined time, an important factor in determining the roughness of the substrate. The contact area is determined by the geometry of the cylinders before and after the cylinder brush, the substrate strip tension, the cylinder brush diameter and similar parameters. The path may be from 10 to 1,000 mm, preferably from 50 to 500 mm. In general, it is true that fewer cylinder brushes are required if the contact distance is large.

One important feature of the present invention is the fact that the cylinder brush or the cylinder brushes is or are neither pure metal wire brushes nor pure polymer fiber brushes, but instead have groups or brush strips which comprise a combination of organic polymer fibers and metal wires. The ratio of fibers to the wires is generally chosen in a range from 0.01:1 to 10:1, preferably from 0.05:1 to 5:1, more preferably from 0.1:1 to 1.0:1. The thickness of the fibers is generally in the range from 0.05 to 3 mm, preferably from 0.1 to 0.5 mm. The thickness of the wires is in general less than that of the fibers and is generally in the range from 0.03 to 2 mm, preferably from 0.07 to 0.3 mm. The lengths of the fibers and wires are preferably the same after they have been fastened to the surface of the cylinder, and their length is from 5 to 300 mm, preferably from 10 to 100 mm. The bundles of fibers and/or metal wires are generally fastened to the cylinder as brush strips. The brush strips contain a suitable mixture of fibers and wires. Alternatively, some of the strips may contain only fibers and others only metal wires, such brush strips being shown in the embodiment according to FIG. 1. Such brush strips are preferably mounted alternately over the cylinder brush circumference.

The fibers generally comprise organic polymers which are selected from polyacrylonitriles, polyamides, polyesters, polyethylenes, polyimides, polyolefins, polypropylenes, polyurethanes, polyvinyl chlorides and cellulose derivatives. The preferred fibers comprise aliphatic polyamides, namely of different nylon variants. Nylon 6, nylon 6.6, nylon 6.10 and nylon 6.12 are particularly preferred. The polymer fibers may be filled with inert particles, for example silicon carbide, in order to increase their abrasion resistance. The metal wires generally comprise metals such as aluminum, brass, bronze, copper, iron and the alloys of these metals as well as steel, preferably stainless steel, which does not rust in the aqueous suspensions.

When electrochemically roughened and/or anodized aluminum substrate strips are used, the electric current may flow along the aluminum substrate and through the metal wires into the cylinder brushes. Hence, every cylinder brush is preferably electrically insulated to prevent the flow of current through the cylinder brush. After wet brushing with the suspension is generally complete, the excess suspension can be squeezed off and/or rinsed off from the roughened surface of the substrate. Embedded particles of the suspension may be removed by etching the roughened aluminum surface. Etching is effected by means of an alkaline solution, which is applied to the brushed surface. Preferred alkaline solutions contain sodium hydroxide, potassium hydroxide, sodium metasilicate, sodium carbonate, sodium aluminate and sodium gluconate. The etch treatment may also be carried out using an acidic solution which contains acids such as hydrofluoric acid, hydrochloric acid, nitric acid, phosphoric acid and sulfuric acid. Etching is preferably effected at a temperature which ranges from room temperature to 90° C., for a period of from 5 to 300 seconds with an etching solution which has a concentration of from 1 to 50% by weight, until from about 0.01 to 10 g/m$^2$ of aluminum has been etched away. The alkali-etched aluminum surface frequently contains alkali-insoluble substances, namely dirt. The surface may then be cleaned to free it from dirt by means of an acidic solution, for example, an aqueous solution of nitric acid, sulfuric acid or phosphoric acid.

The aluminum substrate surface wet-brushed with a suspension may then be electrochemically roughened. Electrochemical roughening is effected in an electrolyte which contains acids, for example nitric acid or hydrochloric acid, with optional additives, such as boric acid, hydrogen peroxide, aluminum chloride and aluminum nitrate, up to a concentration corresponding to the saturation point, in order to support the process constancy and to enhance the electrical conductivity of the electrolyte. The electrochemical roughening can be carried out in two steps, namely a first step with nitric acid, followed by a second step with hydrochloric acid. In a preferred embodiment, the nitric or hydrochloric acid is present in the aqueous electrolyte in an amount of from 1 to 20 grams per liter, an electrolyte temperature of from 20° to 60° C. being maintained. Current is applied via the aluminum substrate and an electrode comprising lead or stainless steel, over a distance of from 0.1 to 20 cm. The applied current density is from 0.1 to 200 A/dm$^2$. The current may be direct current or, preferably, alternating current or a combination of the two current types. The roughening time generally ranges from 1 to 300 seconds but preferably is less than 30 seconds. The preferred operating parameters of the above variables are selected within the stated ranges or may be changed within these ranges if required. The excess acid on the electrochemically roughened aluminum substrate is squeezed off and/or rinsed off before the next additional treatment.

In order to increase the service life of the printing plate, a wet-brushed and additionally electrochemically roughened aluminum surface may be anodized by one of the known methods. This is generally effected in electrolytes which contain sulfuric, phosphoric or oxalic acid in concentrations up to 200 grams per liter, at a temperature of from 20° to 70° C. Anodization is preferably, effected with direct current, current densities generally up to about 60 A/dm$^2$, preferably from 8 to 30 A/dm$^2$ , being applied in order to produce an oxide layer of up to 10 gram per m$^2$, preferably from 0.3 to 5 gram per m$^2$. The electrical voltage is generally from 1 to 100 volt, preferably from 10 to 30 volt, and the residence time in the electrolyte is generally from 1 to 300 seconds, preferably from 5 to 20 seconds, especially 15 seconds. The electrolyte used for the anodization may additionally contain further useful components known per se, for example aluminum sulfate, in a concentration up to the saturation point, in order to support the process constancy and to enhance the electrical conductivity of the electrolyte.

An aluminum substrate having a roughened surface which has an anodically oxidized layer possesses excellent hydrophilic properties and may be coated directly with a photosensitive layer. Alternatively, the substrate may also be subjected to a hydrophilic treatment in a known manner before the photosensitive layer is applied. For example, the substrate can be provided with a silicate layer generally using an alkali metal silicate or with a polymer layer using a polyvinylphosphonic acid.

A photosensitive layer comprises in general a photosensitizer and a resin binder. It may furthermore contain additional components, such as colorants, plasticizer, acid stabilizers, surface compositions, antistatic compositions, UV absorbers, optical brighteners, inert fillers, lubricants and residual coating solutions. A preferred, negative-working photosensitizer is photosensitive polymeric diazonium salt. A preferred, positive-working photosensitizer is a photosensitive naphthoquinonediazide. Other photosensitizers comprise azides, photocleavable compounds and photocurable compounds. Some photosensitizers require an additional coating to prevent in particular the penetration of oxygen. The resin binder can be selected from a group consisting of vinyl acetal polymers, styrene/maleic anhydride copolymers and phenol resins. Preferably, the amount of the resin binder in the photosensitive layer is from 30 to 95% by weight, preferably from 50 to 90% by weight. The photosensitive layer may also be coated with a spacer layer in order to reduce the vacuum generation time during exposure. The thickness of the space layer is from 2 to 15 μm, preferably from 6 to 10 μm, and its composition is selected from resins such as silicon rubber, gelatine, polyvinylalcohol, polyvinylpyrrolidone, epoxy resin, polyvinylbutyral. The photosensitizer is present in an amount of from 5 to 70% by weight, preferably from 10 to 50% by weight, in the photosensitive layer.

The additives for the photosensitive layer may be mixed with compatible solvents, such as ethanol, ethylene glycol monomethyl ether, gamma-butyrolactone, propylene glycol monomethyl ether and diethyl ketone. The brushed aluminum surface is then coated with such a solution. The photosensitive layer has a preferred dry layer weight of from 0.1 to 5 g/m$^2$, more preferably from 0.2 to 2 g/m$^2$. The photosensitive layer is exposed imagewise by known techniques. Such an exposure can be carried out with the aid of a UV light source through a film mask under vacuum frame conditions. Mercury vapor discharge lamps and metal halide lamps are preferably used. Other radiation sources are carbon arc lamps, pulsed xenon lamps and lasers. Light absorption filters can be used for reducing the light radiation in the material. After exposure, the photosensitive layer can be developed by dissolving away the nonimage surfaces from the photosensitive layer using a suitable developer and is then dried. Any developer solution which removes the nonimage areas of the photosensitive layer in a satisfactory manner after exposure to light while leaving the image areas may be used. Suitable developer compositions comprise solutions which contain additives such as sodium metasilicate, trisodium phosphate, monosodium phosphate and alkyl hydroxyles in water for diazide coatings, n-propanol in water for diazonium salt coatings and benzene for azide coating. The developed image on the printing plate may be protected by a conservation treatment.

The Examples described below illustrate the invention without restricting the subject of the invention, and, in connection with the ratio of the number of fibers to the number of metal wires, it should be noted that about 10 fibers or 100 metal wires can be arranged over 1 $mm^2$ of brush strip, and that the substrate is wet-brushed on one side.

EXAMPLE 1

A substrate comprising an aluminum alloy 1100 having a maximum strip width of 1.3 m and a thickness of 0.3 mm is prepared at a strip running speed of 18 m/min for the production of a printing plate. The substrate strip is first cleaned, degreased and lightly etched by means of a treatment in an aqueous alkali metal solution which contains about 20 g per liter of sodium hydroxide, aluminum ions and a degreasing composition, the temperature being kept at about 65° C. for a residence time of 7 seconds. The substrate strip is then wet-brushed on one side with a suspension, the cylinder brush having a diameter of 0.6 m, a width of 1.5 m and a rotational speed of 500 revolutions per minute. 80 brush strips are mounted over the cylinder width, of which 60 brush strips contain nylon 6.6 fibers having a diameter of 0.3 mm and the remaining 20 brush strips contain stainless steel wires having a diameter of 0.1 mm. The brush strips are arranged in recurring groups of 3 strips of nylon with one strip of metal. The contact path of the cylinder brush with the aluminum surface is 550 mm. The suspension comprises 20% by weight of abrasive particles in water. The particles comprise 99.6% by weight of silica, 0.1% by weight of alumina, 0.02% by weight of iron oxide and 0.2% by weight of other materials. The average particle size is 19 μm. The suspension comprises 3000 liters, which are constantly circulated and are transported to the cylinder brushes at a rate of 200 liters per minute. The roughened substrate strip is then rinsed with water, squeezed off, dried, anodized, hydrophilized and dried again. The anodization is effected at 45° C. with a solution which contains 150 g per liter of concentrated sulfuric acid (from 95 to 98% by weight) and about 6 g per liter of aluminum sulfate octadecahydrate. The direct current density is 26 $A/dm^2$ and the direct current is switched on intermittently for a total time of 8 seconds, an oxide layer of 2 $g/m^2$ being produced. The anodized surface is rendered hydrophilic by immersion in an aqueous solution which contains 2.2% by weight of polyvinylphosphonic acid at a temperature of 75° C.

The ratio of the number of polymer fibers to the number of metal wires is 0.3. This also applies to Examples 3 to 9.

The bristles of cylinder brush 1 are 40 mm long at the beginning of the wet brushing. After 250,000 m of substrate strip have been brushed, the bristles have been worn down to a length of 7 mm. The surface roughness of the substrate at the beginning of the wet brushing is similar to that after 250,000 m of substrate has passed through. The center line average value $R_a$ is 0.38 μm in the strip running direction and 0.42 μm transverse to the strip running direction, so that the difference between the two center line average values is about 10.5%, based on the value in the strip running direction.

COMPARATIVE EXAMPLE A

The wet brushing according to Example 1 is repeated, except that the cylinder brush contains only brush strips of nylon 6.6 fibers. The bristles are worn down to a level of 7 mm after only 30,000 m of substrate have passed through. This means that the life or the service life of the cylinder brush is only ⅛ of that of Example 1. The surface roughness is similar to that in Example 1, namely with a center line average value $R_a$ of 0.36 μm in the strip running direction and 0.41 μm transverse to the strip running direction, resulting in a difference between the two center line average values of about 14%, based on the center line average value in the strip running direction.

COMPARATIVE EXAMPLE B

Example 1 is repeated with a cylinder brush 1 in which, however, 20 brush strips comprising metal wire are replaced by an identical number of brush strips comprising nylon 6.6 fibers having a diameter of 0.5 mm. The bristles of the cylinder brush are worn down to 7 mm after only 30,000 m of the substrate strip have passed through. In this Comparative Example B, there is no increase in the life or service life of cylinder brush 1. The surface roughness is similar to that according to Example 1.

COMPARATIVE EXAMPLE C

Example 1 is repeated with cylinder brush 1, in which 60 brush strips comprising fibers having a diameter of 0.3 mm are replaced by an identical number of brush strips comprising fibers having a diameter of 0.5 mm, and 20 brush strips comprising metal wire are replaced by an identical number of brush strips comprising fibers having a diameter of 0.3 mm. A configuration of cylinder brush 1 which is opposite that in Comparative Example B is thus obtained. The bristles are worn down to 7 mm after 40,000 m of strip have passed through. This constitutes a slight improvement over Comparative Examples A and B, but the result is by no means as good as that according to Example 1. The center line average value $R_a$ changes considerably in this Comparative Example C and is 0.68 μm in the strip running direction and 0.80 μm transverse to the strip running direction, resulting in a difference of about 17.6%, based on the roughness in the strip running direction.

COMPARATIVE EXAMPLE D

Example 1 is repeated with a cylinder brush 1 in which all brush strips comprise stainless steel wires. The roughness is similar to that obtained by dry wire brushing, namely of small depth and oriented. Another disadvantage is that higher tensile forces are required since the wires hollow out the aluminum surface of the substrate strip moving in the opposite direction.

EXAMPLE 2

Example 1 is repeated with a cylinder brush 1 in which the number of fiber brush strips is 70 instead of 60 and the number of metal wire brush strips is 10 instead of 20. The ratio of the number of fibers to the number of metal wires is 0.7. The surface roughness is similar to that in Example 1. The bristles are worn down to a length of 7 mm after about 150,000 m of strip have passed through. The life of cylinder brush 1 is five times as long as that in Comparative Example A.

EXAMPLE 3

Example 1 is repeated, the mean particle size of the suspension being 0.11 μm instead of 0.19 μm. The center line average value $R_a$ is 0.32 μm in the strip running direction and 0.36 μm transverse to the strip running direction.

EXAMPLE 4

Example 1 is repeated with a suspension in which the suspension concentration is 30% by weight instead of 20% by weight. The center line average value $R_a$ is 0.45 μm in the strip running direction and 0.51 μm transverse to the strip running direction.

EXAMPLE 5

Example 4 is repeated, the strip running speed being 45 m/min instead of 18 m/min and the anodizing current being increased by a factor of 2.5 in proportion to the strip running speed, in order to obtain the same oxide weight. The bristles of cylinder brush 1 are worn down to a length of 7 mm after 400,000 m of strip have passed through. The surface roughness is slightly lower compared with Example 4 but is still uniform. The center line average values are 0.37 μm in the strip running direction and 0.42 μm transverse to the strip running direction.

COMPARATIVE EXAMPLE E

Example 5 is repeated, but all brush strips comprise exclusively nylon fibers. The nylon bristles are worn down to a length of 7 mm after only 48,000 m. This in turn means a reduction in the service life or in the period of use of the cylinder brushes to ⅛ of the value in Example 5. The surface roughness is similar to that of Example 4.

EXAMPLE 6

Substrate strips comprising an aluminum alloy 3003 with a maximum strip width of 1.2 m and a thickness of 0.4 mm are prepared at a strip speed of 18 m/min for roughening. The strips are first cleaned and degreased by a treatment with an aqueous alkaline solution which contains about 5% of a weakly alkaline spray degreasing and cleaning composition for metal surfaces with special additives for refining phosphate layers, at a temperature of about 55° C. The strips are then wet-brushed with a suspension by means of 4 cylinder brushes which have a diameter of 0.3 m and a width of 1.5 m. Forty brush strips are arranged on each cylinder brush, of which 30 brush strips comprise nylon 6.6 fibers having a diameter of 0.3 mm and the remaining 10 brush strips comprise stainless steel wires having a diameter of 0.1 mm. The brush strips are present in recurring groups of 3 strips of nylon with one strip of metal wire and are a distance apart. The contact distance of a cylinder brush with the aluminum surface is 60 mm. The suspension comprises 22% by weight of abrasive particles in water. The particles are composed of 59.7% by weight of silica, 22.7% by weight of alumina and 16.6% by weight of other abrasive materials. The mean particle size is 48 μm. The suspension comprises 1200 liters, which continuously circulates.

The roughened substrate strip is rinsed with water, squeezed off, dried, anodized, hydrophilized and dried again. The anodization is effected at 40° C. with the solution which contains 190 g per liter of concentrated sulfuric acid (95 to 98% by weight) and about 10 g per liter of aluminum sulfate octadecahydrate. Direct current is applied in order to obtain an oxide layer of 0.5 g/m$^2$. The anodized surface is hydrophilized by immersion in an aqueous solution at 72° C. which contains 2% of polyvinylphosphonic acid.

The bristles on the cylinder brush are 40 mm long at the beginning of the roughening procedure. After about 1 million meters of substrate strip have been roughened, the length of the bristles is still 7 mm. The surface roughness of the material at the beginning is similar to that after the roughening of 1 million meters of substrate strip. The center line average values $R_a$ are 0.32 μm in the strip running direction and 0.35 μm transverse to the strip running direction.

COMPARATIVE EXAMPLE F

Example 6 is repeated, but all brush strips comprise nylon 6.6 fibers. The bristles are worn down to a length of 7 mm after only 200,000 m of strip have passed through. This means a reduction of the life of the cylinder brush by a factor of 5. The surface roughness is similar to that in Example 6, namely with center line average values $R_a$ of 0.31 μm in the strip running direction and 0.35 μm transverse to the strip running direction.

COMPARATIVE EXAMPLE G

Example 6 is repeated, the first cylinder brush having only metal wire strips and the other three cylinder brushes being equipped only with nylon fibers, instead of mixed brush strips for all 4 cylinder brushes. The roughness of the surface is more highly oriented than in the case of Example 6. The nylon bristles are worn down to a length of 7 mm after only 200,000 m of substrate strip have passed through.

COMPARATIVE EXAMPLE H

Example 6 is repeated, the first three cylinder brushes having only nylon fibers and the last cylinder brush being equipped only with metal wires. The surface roughness is more highly oriented than in Example 6 and in Comparative Example G, with a center line average value $R_a$ of 0.28 μm in the strip running direction and 0.38 μm transverse to the strip running direction. The nylon bristles are worn down to the same extent as in Comparative Example G.

EXAMPLE 7

Example 6 is repeated, the strip being roughened on both sides. Four cylinder brushes are present for roughening one side and four further cylinder brushes for roughening the other side. In all 8 cylinder brushes, the ratio of nylon fibers to metal wires is 3:1, similarly to Example 6. The mixed bristles are worn down to the same extent as stated in Example 6.

EXAMPLE 8

The aluminum strip of Example 1 is coated with the following positive-working photosensitive layer, which is then dried at 150° C. to a dry weight of 2 g/m$^2$. The strip is cut into presensitized printing plates. The composition of the photosensitive layer is as follows, the numbers stated relating to percentages by weight:

4.116 Ester of bis-(3-benzoyl-4,5,6-trihydroxy phenyl)-methane and 1,2-naphthaquinone-2-diazide-5-sulfonic acid, as described in U.S. Pat. No. 4,407,926, which is expressly incorporated by reference herein in its entirety 3.900 Novolak resin 0.021 Oil-soluble yellow dye (yellow GGN)

10.334 Cyclohexanone 75.856 Ethylene glycol monomethyl ether

A suitable novolak resin is, for example, Alnovol™ PN 429 from Hoechst Aktiengesellschaft.

The presensitized plate obtained is exposed through a screened positive film using a metal halide lamp. The plate is then developed for 3.5 minutes with the developer mentioned below. The exposed surfaces are removed by this developer. The plate is then inked and is treated with a preservative. The processed plate is used in an offset printing press and gives over 100,000 prints of good image quality. The developer has, for example, the following composition:

92.3 Water 3.96 Sodium metasilicate pentahydrate 3.40 Disodium phosphate decahydrate 0.34 Monosodium phosphate monohydrate

EXAMPLE 9

The aluminum strip of Example 6 is coated with the following negative-working photosensitive layer, which is dried at a temperature of 125° C. to a dry weight of 0.7 g/m$^2$. The numbers stated are in percent by weight.

4.116 Polycondensate of 3-methoxy-4-diazodiphenylamine sulfate and 4,4'-bismethoxymethyldiphenyl ether, precipitated as mesitylene sulfonate, as described in U.S. Pat. No. 3,839,392, which is expressly incorporated by reference herein in its entirety 3.900 Polyvinyl acetal/polyvinyl alcohol/polyvinyl acetate resin with 76.6% by weight of acetal groups, 9.8% by weight of hydroxyl groups and 13.6% by weight of acetate groups, as described in U.S. Pat. No. 4,808,508, which is expressly incorporated by reference herein in its entirety 0.288 Phosphoric acid (85%)

0.021 4-Phenylazodiphenylamine 5.555 Dispersion of 6.43% by weight of colored pigments and 5.47% by weight of polyvinyl acetal/polyvinyl alcohol/polyvinyl acetate resin with 76.6% by weight of acetal groups, 9.8% by weight of hydroxyl groups and 13.6% by weight of acetate groups in a 1:1 ratio of gamma-butyrolactone to propylene glycol monomethyl ether 10.334 Gamma-butyrolactone 75.786 Propylene glycol monomethyl ether.

Propylene glycol monomethyl ether is, for example, a product from Dow Chemical, USA.

The presensitized plate obtained is exposed through a screened negative film and is developed with the developer described below, which removes the unexposed parts. The developed plate gives good image quality even in a print run of more than 60,000. The composition of the developer is:

89.306 Water 0.227 Monosodium phosphate 2.230 Trisodium phosphate 8.237 Sodium tetradecylsulfate Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A process for the mechanical roughening of a surface of a printing plate substrate comprising aluminum or aluminum alloy, which process comprises wet brushing the substrate with a suspension of from 5 to 80% by weight of abrasive particles in water, with a brush on which organic fibers and metal wires are arranged side by side said brushing is effected using a brush on which organic fibers and metal wires are arranged aide by side in a ratio of the organic fibers to the metal wires in the range of 0.01:1 to 10:1.

2. The process as claimed in claim 1, wherein the particle size in the suspension is from 20 to 50 μm.

3. The process as claimed in claim 1, wherein the ratio of the organic fibers to the metal wires is in the range from 0.05:1 to 5:1.

4. The process as claimed in claim 1, wherein the ratio of the organic fibers to the metal wires is in the range from 0.1:1 to 1.0:1.

5. The process as claimed in claim 1, wherein the particle size in the suspension is from 1 to 500 μm.

6. The process as claimed in claim 5, wherein the particles in the suspension are composed of from 49 to 99.6% by weight of silica, from 01. to 23.7% by weight of alumina, and from 0.2 to 16.6% by weight of other abrasive material which is abrasive to the aluminum or aluminum alloy.

7. The process according to claim 6, wherein the suitable abrasive materials comprise diamond dust, quartz, flintstone, granite, alumina, silica, kieselguhr, sand, emery abrasives composed of iron silicates and aluminum silicates, talc, pumice, corundum, dolomite, magnesium oxide, clay, zirconia, iron, or tungsten carbide.

8. The process as claimed in claim 1, wherein the mechanically measured center line average roughness value $R_a$ in a running direction of the printing plate substrate and transverse to the running direction differ from one another by not more than 14%, based on the $R_a$ in the running direction.

9. The process as claimed in claim 7, wherein the center line individual roughness values $R_a$ in the running direction are in the range from 0.32 to 0.47 μm and the center line individual roughness values $R_a$ transverse to the running direction are in the range from 0.35 to 0.50 μm.

10. The process as claimed in claim 1, wherein the organic fibers comprise polymers and the metal wires comprise stainless steel.

11. The process as claimed in claim 10, wherein the polymers comprise a polyamide.

* * * * *